US008807012B1

(12) United States Patent
Bennett et al.

(10) Patent No.: US 8,807,012 B1
(45) Date of Patent: Aug. 19, 2014

(54) HARMONIC ENGINE

(75) Inventors: Charles L. Bennett, Livermore, CA (US); Noel Sewall, Livermore, CA (US); Carl Boroa, Milpitas, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 605 days.

(21) Appl. No.: 13/221,783

(22) Filed: Aug. 30, 2011

Related U.S. Application Data

(60) Provisional application No. 61/378,327, filed on Aug. 30, 2010.

(51) Int. Cl.
*F01L 23/00* (2006.01)

(52) U.S. Cl.
USPC ..... 91/273; 91/270

(58) Field of Classification Search
USPC ..... 91/266, 270, 273, 454
See application file for complete search history.

(56) References Cited

U.S. PATENT DOCUMENTS

| | | | | |
|---|---|---|---|---|
| 14,690 | A | 4/1856 | Ericsson | |
| 1,038,805 | A | 9/1912 | Webb | |
| 1,306,865 | A | 6/1919 | Stoddard | |
| 3,708,979 | A | 1/1973 | Bush et al. | |
| 4,008,574 | A | 2/1977 | Rein | |
| 4,342,448 | A | 8/1982 | Wallis | |
| 5,058,538 | A | 10/1991 | Erickson et al. | |
| 5,148,066 | A | 9/1992 | Beale et al. | |
| 5,261,358 | A | 11/1993 | Rorke | |
| 6,062,181 | A | 5/2000 | von Gaisberg et al. | |
| 6,302,068 | B1 | 10/2001 | Moyer | |
| 6,394,416 | B2 | 5/2002 | von Gaisberg | |
| 6,470,683 | B1 | 10/2002 | Childs et al. | |
| 7,603,858 | B2 * | 10/2009 | Bennett | 60/517 |
| 7,637,457 | B2 * | 12/2009 | Bennett | 244/59 |
| 8,689,673 | B2 * | 4/2014 | Berkun | 91/273 |

FOREIGN PATENT DOCUMENTS

WO WO 2009129129 A1 * 10/2009

* cited by examiner

*Primary Examiner* — Thomas E Lazo
(74) *Attorney, Agent, or Firm* — James S. Tak

(57) ABSTRACT

An engine based on a reciprocating piston engine that extracts work from pressurized working fluid. The engine includes a harmonic oscillator inlet valve capable of oscillating at a resonant frequency for controlling the flow of working fluid into of the engine. In particular, the inlet valve includes an inlet valve head and a spring arranged together as a harmonic oscillator so that the inlet valve head is moveable from an unbiased equilibrium position to a biased closed position occluding an inlet. Upon releasing the inlet valve the inlet valve head undergoes a single oscillation past the equilibrium positio to a maximum open position and returns to a biased return position close to the closed position to choke the flow and produce a pressure drop across the inlet valve causing the inlet valve to close. Protrusions carried either by the inlet valve head or piston head are used to bump open the inlet valve from the closed position and initiate the single oscillation of the inlet valve head, and protrusions carried either by the outlet valve head or piston head are used to close the outlet valve ahead of the bump opening of the inlet valve.

17 Claims, 5 Drawing Sheets

HARMONIC ENGINE

II. CROSS-REFERENCE TO RELATED APPLICATIONS

This application claims the benefit of U.S. provisional application No. 61/378,327 filed Aug. 30, 2010, entitled, "Dynamic Latching Harmonic Engine" by Charles L. Bennett, incorporated by reference herein.

I. FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

III. BACKGROUND OF THE INVENTION

A. Technical Field

This invention generally relates to pressure activated engines. More particularly, this invention is a reciprocating-piston engine having a harmonic oscillator valve controlling the admission of a pressurized expansible fluid into an expansion chamber and a spring-loaded outlet valve controlling the exhaust of lower pressure fluid from the expansion chamber.

B. Description of the Related Art

Engines that transform the internal energy within a high-pressure expansible fluid into useful mechanical energy are well known. Perhaps the earliest and best known is the steam engine. Central to the operation of such an engine is the valve mechanism that controls the admission of high-pressure fluid into an expansible chamber and the release of low-pressure fluid from the expansible chamber. The power and efficiency of such an engine is strongly driven by the phasing of the opening and closing of the inlet and outlet valves. Maintaining high efficiency under a variety of steam pressure conditions and operating speeds requires changing the timing or cutoff of the valves, and a number of mechanisms are known to achieve such variable valve timing. Among these are the Corliss valve mechanisms described in US6162 and US8253. With such mechanisms proper lubrication is required in order to prevent untimely wear of the sliding parts, and the relative complexity of such mechanisms is a disadvantage.

Reciprocating pneumatic engines that avoid the use of cams or sliding valves are known. In one such device, a spring loaded inlet valve is pushed open by mechanical contact with a piston, as it approaches the TDC (Top Dead Center) position, to admit high-pressure gas into a cylinder. As the piston moves towards BDC (Bottom Dead Center), an outlet port in the side of the cylinder is uncovered, and pressurized gas within the cylinder is vented to the atmosphere. Such engines are mechanically quite simple, but suffer from relatively low efficiency, primarily because on the return stroke of the piston from BDC to TDC, after the outlet port is covered, the piston compresses gas trapped within the cylinder and thus robs the engine of potential power.

A recent pneumatic engine described in pending patent U. Publication No. 2011/0030548 by Andrew C. Berkun, known as a "Slam Valve Motor", shows a normally open inlet valve, in normal operation held closed by the pressure difference between the external high pressure supply and the lower pressure within the engine cylinder until pushed open by mechanical contact with a piston, and a normally open outlet valve, pushed closed by mechanical contact with the piston.

Berkun teaches that the inlet valve moves to the closed position when flow through it exceeds a critical flow rate. Attaining the critical flow required for closure of the inlet valve from its fully open position, leads to a corresponding limitation on the minimum operational speed of the engine, and this can be disadvantageous under some circumstances. This limitation of Berkun's slam valve motor is that, in order to close the inlet valve, a certain critical flow speed must be reached at some phase in the power stroke of the engine. Thus, at low engine speed, if the critical flow speed is not attained, the slam valve motor may not be able to operate.

The harmonic engine disclosed in U.S. Pat. No. 7,603,858, teaches the use of a harmonic oscillator inlet valve together with a harmonic oscillator outlet valve. In this work, a latch mechanism is incorporated in order to ensure the closure of the inlet valve after a cycle of harmonic oscillation. In this prior art, however, the ratio of the period of the inlet valve oscillator to the engine cycle period allows only a narrow range in the ratio of the inlet supply pressure to the outlet release pressure. Also, the ratio of the outlet harmonic oscillator period to the engine period may only vary slightly. As a result, there is little flexibility in the choice of the operating conditions, viz. the engine speed, the pressure ratio and the output power level.

IV. SUMMARY OF THE INVENTION

One aspect of the present invention includes an engine comprising: a reciprocating-piston expander comprising: an expander cylinder having an inlet and an outlet; a piston head slidable in said expander cylinder and together enclosing an expansion chamber accessible by the inlet and the outlet; an intake header in fluidic communication with the inlet for channeling working fluid from a pressurized fluid source into the expansion chamber; an exhaust header in fluidic communication with the outlet for channeling working fluid exhausted out from the expansion chamber; an inlet valve for controlling the flow of working fluid from the intake header through the inlet to effect a power stroke of the expander, said inlet valve comprising an inlet valve head and a resiliently biasing member arranged together as a harmonic oscillator so that the inlet valve head is moveable against an equilibrium restoring force of the resiliently biasing member from an unbiased equilibrium position located in the intake header to a biased closed position occluding the inlet, and so that upon releasing from the closed position the inlet valve head undergoes a single oscillation past the equilibrium position to an oppositely biased maximum open position and returns to a biased return position between the closed and equilibrium positions to choke the flow of working fluid and produce a pressure drop across the inlet valve causing the inlet valve to close, said inlet valve head protruding in part into the expansion chamber when in the closed position so as to enable the piston to bump open the inlet valve from the closed position and initiate the single oscillation of the inlet valve head; an outlet valve for controlling the flow of working fluid exhausted out through the outlet to the exhaust header during a return stroke of the expander, said outlet valve comprising an outlet valve head, stopper, and a resiliently biasing member arranged so that the outlet valve head is moveable against an equilibrium restoring force of the resiliently biasing member from a maximum open position located in the expansion chamber and delimited by the stopper to a biased closed position occluding the outlet; an outlet valve closing spring carried by one of the outlet valve head and the piston head and positioned therebetween so that when the other non-carrying one of the outlet valve head and the piston head comes in contact with and resiliently biases the outlet valve closing spring the outlet valve is moved by the outlet valve closing spring from the maximum open position to the closed position ahead of the bump opening of the inlet valve; and periodic return means operably connected to the piston head for effecting the return stroke of the expander after each power stroke.

Another aspect of the present invention includes an engine comprising: a reciprocating a reciprocating-piston expander comprising: an expander cylinder having an inlet and an outlet; a piston head slidable in said expander cylinder and together enclosing an expansion chamber accessible by the inlet and the outlet; an intake header in fluidic communication with the inlet for channeling working fluid from a pressurized fluid source into the expansion chamber; an exhaust header in fluidic communication with the outlet for channeling working fluid exhausted out from the expansion chamber; an inlet valve for controlling the flow of working fluid from the intake header through the inlet to effect a power stroke of the expander, said inlet valve comprising an inlet valve head and a resiliently biasing member arranged together as a harmonic oscillator so that the inlet valve head is moveable against an equilibrium restoring force of the resiliently biasing member from an unbiased equilibrium position located in the intake header to a biased closed position occluding the inlet, and so that upon releasing from the closed position the inlet valve head undergoes a single oscillation past the equilibrium position to an oppositely biased maximum open position and returns to a biased return position between the closed and equilibrium positions to choke the flow of working fluid and produce a pressure drop across the inlet valve causing the inlet valve to close; an outlet valve for controlling the flow of working fluid exhausted out through the outlet to the exhaust header during a return stroke of the expander, said outlet valve comprising an outlet valve head, stopper, and a resiliently biasing member arranged so that the outlet valve head is moveable against an equilibrium restoring force of the resiliently biasing member from a maximum open position located in the expansion chamber and delimited by the stopper to a biased closed position occluding the outlet; a protrusion carried by one of the inlet valve head and the piston head and positioned therebetween so that when the other non-carrying one of the inlet valve head and the piston head comes in contact with the protrusion the inlet valve is bumped open from the closed position to initiate the single oscillation of the inlet valve head; and an outlet valve closing spring carried by one of the outlet valve head and the piston head and positioned therebetween so that when the other non-carrying one of the outlet valve head and the piston head comes in contact with and resiliently biases the outlet valve closing spring the outlet valve is moved by the outlet valve closing spring from the maximum open position to the closed position ahead of the bump opening of the inlet valve; and periodic return means operably connected to the piston head for effecting the return stroke of the expander after each power stroke.

V. BRIEF DESCRIPTION OF THE DRAWINGS

The accompanying drawings, which are incorporated into and form a part of the disclosure, are as follows.

VI. DETAILED DESCRIPTION

Generally, the present invention is an engine that converts the energy contained within a pressurized supply of a working fluid, such as steam or compressed air, into mechanical power, and is well suited for connection to an alternating current electrical generator. The engine generally comprises a reciprocating-piston expander assembly and a crank assembly or other periodic return mechanism or method operably connected to the piston for effecting the return stroke of the expander after each power stroke. The expander generally includes the following components and sub-assemblies: a harmonically oscillating inlet valve for controlling flow of high pressure working fluid into expansion chamber from an inlet header conduit, manifold or duct (hereinafter "intake header") that is connectable to a source of pressurized working fluid; a resiliently biasing outlet valve for controlling flow out of expansion chamber to an exhaust header conduit, manifold or duct (hereinafter "exhaust header") capable of venting the expanded, low pressure working fluid. In particular, the inlet valve includes an inlet valve head and a resiliently biasing member arranged together as a harmonic oscillator so that when the inlet valve head is displaced from a closed position (occluding the inlet to an expansion chamber) it undergoes a single oscillation to a maximum open position and returning to a return position where it chokes the flow of working fluid so as to close the inlet once again in a single two-stroke period of the engine. Because of this harmonic oscillation aspect of the inlet valve, the engine is characterized as a "harmonic engine." And the crank assembly (for example of a type conventionally known in the art) is operably connected to the piston for converting reciprocating motion into rotary power output. For example the crank assembly may include a flywheel having rotational inertia which is transferred to the piston via the crankshaft.

First Example Embodiment

Figure 1:
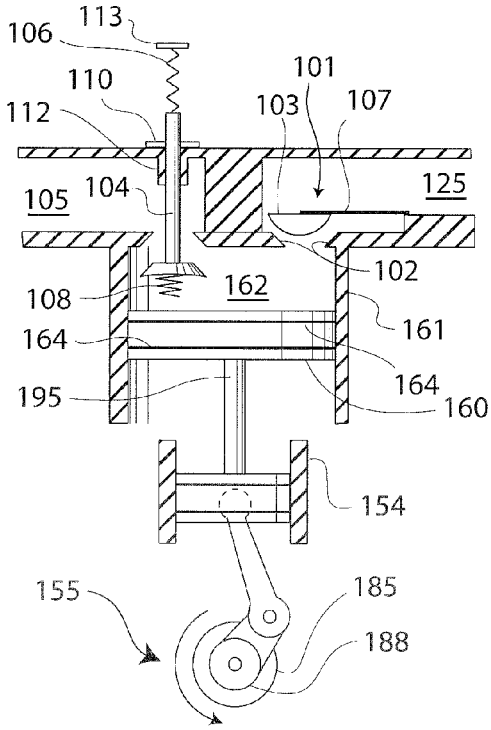
FIG. 1 is an overall cross-sectional view of the first exemplary embodiment of the present invention in its fully relaxed configuration.

Turning now to the drawings, FIGS. 1-5 show a first exemplary system of the engine of the present invention. In particular, FIG. 1 shows the harmonic engine in a static, non-operational state such as typically seen just prior to startup, and FIGS. 2-5 show the harmonic engine in various dynamic states of its two-stroke operation. The harmonic engine is shown comprising the following components and sub-assemblies. First a reciprocating-piston expander is shown comprising an expander cylinder 161 having an inlet and an outlet. The expander also includes a piston head 160 axially slidable in the expander cylinder and together enclosing an expansion chamber 162 accessible by the inlet and the outlet. Also the expander includes an intake header 125 in fluidic communication with the inlet for channeling working fluid from a pressurized fluid source into the expansion chamber, and an exhaust header 105 in fluidic communication with the outlet for channeling working fluid exhausted out from the expansion chamber. A harmonically oscillating inlet valve 101 is provided for controlling flow of high pressure working fluid into expansion chamber 162 from the intake header, and a resiliency biasing (e.g. spring-loaded) upper outlet valve 104 is also provided for controlling flow out of expansion chamber 162 to the exhaust header 105 capable of venting the expanded, low pressure working fluid. Finally, a crank assembly 155 as conventionally known in the art is shown operably connected to a piston 160 for converting reciprocating motion into rotary power output. In this embodiment the rotary power output is shown connected to a flywheel 185 and an induction motor/generator 188 further connected to an alternating current electric power grid. Each of these and other components are discussed in detail as follows.

Inlet Valve

The inlet valve 101 in the first exemplary configuration is shown in FIG. 1 and has a inlet valve head portion 103 (particularly shown as a convex frusto-spherical section) that is attached to a resiliently biasing member 107 such as a mono-leaf spring, or flexure bearing spring, that tends to hold the valve open by positioning the inlet valve head away from piston 160. In particular, the mono-leaf spring is shown cantilevered with the inlet valve head connected at one end. The end of the flexure spring 107 opposite the valve head 103 is attached to a wall of the inlet header duct 125. The inlet valve has a lower surface 109 of a lower portion that extends or protrudes into the interior of cylinder 161, i.e. expansion chamber, when valve 101 is in its fully closed position shown in FIG. 2 so as to enable the piston to bump open the inlet valve from the closed position and initiate the single oscillation of the inlet valve head. The inlet valve preferably occludes when pushed toward piston 160, and opens when pulled away from the piston. The inlet valve seat 102 has a chamfered surface so that, when closed, the preferably convex spherical surface contour of the lower surface 109 of the inlet valve head 103 contacts the conical inlet valve seat 102 along a circle.

The inlet valve head 103 and its opening spring 107 form a spring-mass system of a harmonic oscillator which, when the inlet valve is displaced from its equilibrium position, experiences a restoring force proportional to the displacement according to Hooke's law, as known in the art. This oscillator preferably has a high quality factor Q value, so that, while freely oscillating, many cycles of oscillation occur before the amplitude of oscillation decays significantly. The significance of the high Q value in the context of this invention is that after a single oscillation, starting from a closed position, in the absence of other forces, the inlet valve returns almost all the way back to its closed position. In practice a Q value of at least 160 is preferred, as this returns the inlet valve to within 1% (relative to the full excursion of the valve) of its closed position after a single oscillation. With such close return to the closed position, the flow passageway from inlet duct 125 to expansion space 162 effectively forms a converging-diverging nozzle. With a sufficiently high Q, the narrowness of the throat of the converging-diverging nozzle section has the practical effect of choking the flow of working fluid between the inlet duct 125 and the expansion space 162. As is known in the art of converging-diverging nozzles, flow is choked by the limitation that the flow speed cannot exceed the speed of sound at the throat of the nozzle. With sufficiently high Q, and thus a sufficiently small throat area, even at the lowest practical engine operating speed, the flow at the throat reaches the speed of sound and is thus choked. The form of inlet valve shown is conducive to attaining very high Q values, as the frictional losses of flexure bearings, such as 107, constructed of high quality spring steel, are very low. Thus, in an example embodiment, the resiliently biasing member of the inlet valve has a high quality Q factor greater than about 160 so that the return position of the inlet valve head after undergoing the single oscillation is substantially near the closed position.

Figure 2:
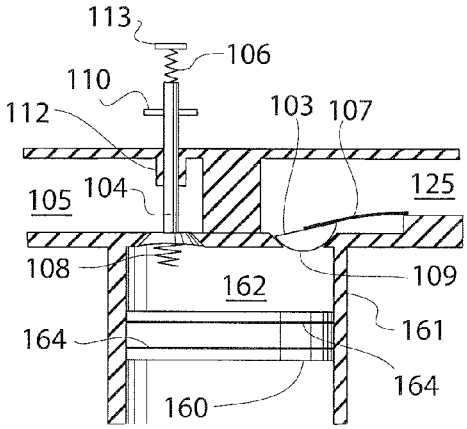
FIG. 2 is a cross-sectional view of the top portion of the first embodiment showing both inlet and outlet valves fully closed.

The completely relaxed neutral position of the inlet valve 101 is shown in FIG. 1. This position is found in the de-energized, "cold-start" configuration of the engine, without pressurized working fluid supplied to the inlet manifold, and before the piston begins to reciprocate and produce power. The inlet valve is thus a normally open valve. When inlet valve 101 is closed, as shown in FIG. 2, the inlet valve is displaced from its equilibrium position, inlet valve spring 107 is flexed, and there is a restoring force produced by spring 107 that tends to open the inlet valve.

Thus the inlet valve is used for controlling the flow of working fluid from the intake header through the inlet to effect a power stroke of the expander. The inlet valve head and the resiliently biasing member of the inlet valve are arranged together as a harmonic oscillator so that the inlet valve head is moveable against an equilibrium restoring force of the resiliently biasing member from an unbiased equilibrium position located in the intake header to a biased closed position occluding the inlet. Furthermore, this arrangement enables the inlet valve head, upon being released from the closed position to undergo a single oscillation past the equilibrium position to an oppositely biased maximum open position and return to a biased return position between the closed and equilibrium positions. This chokes the flow of working fluid and produces a pressure drop across the inlet valve causing the inlet valve to close. Furthermore, the inlet valve head may be configured to protrude in part into the expansion chamber when in the closed position so as to enable the piston to bump open the inlet valve from the closed position and initiate the single oscillation of the inlet valve head.

Outlet Valve

The outlet valve 104 is also shown in FIG. 1 as a poppet valve connected to a resiliently biasing member, flexure or spring 106 that tends to hold the valve open and pushed toward piston 160. The outlet valve has a resiliently biasing member, such as outlet valve closing spring 108 attached to it that faces piston 160. The outlet valve also has a stopper 110 attached to it that prevents the outlet valve from moving past its designed fully open position in the direction towards the piston.

Outlet valve closing spring 108 is constructed so that it extends farther into cylinder 161 than does the bottom of the inlet valve 109 when both the inlet and outlet valves are fully closed as shown in FIG. 2. By this construction, as the piston approaches the top of its travel, it is assured to encounter outlet valve closing spring 108 prior to contacting the bottom of inlet valve 109.

Outlet valve 104 is open (FIG. 1) when spring 106 is maximally extended towards its neutral position consistent with the constraint of stopper 110, and closed (FIG. 2) when the outlet valve is displaced maximally away from it's neutral position. When outlet valve 104 is closed, spring 106 is compressed with respect to its neutral position and produces a restoring force tending to push outlet valve 104 into cylinder 161 towards piston 160. When outlet valve 104 is fully open, spring 106 is still compressed with respect to its neutral position, producing a force tending to keep outlet valve open as far as the stopper 110 allows.

In this embodiment, outlet valve 104 penetrates outlet valve guide 112, and a support 113 for outlet opening spring 106 is positioned above the valve. The external location of support 113 permits modification of the strength of the restoring force produced by spring 104 in its fully compressed position even while the engine is in operation by adjustment of the position of support 113. The close fit of valve guide 112 suppresses leakage of working fluid to the outside of the engine. If needed, an optional valve stem seal (not shown) could be added.

Generally therefore the outlet valve operates to control the flow of working fluid exhausted out through the outlet to the exhaust header during a return stroke of the expander. To accomplish this, the outlet valve head, stopper, and the resiliently biasing member of the outlet valve are arranged so that the outlet valve head is moveable against an equilibrium restoring force of the resiliently biasing member from a maximum open position located in the expansion chamber and delimited by the stopper to a biased closed position occluding the outlet. And the outlet valve closing spring (which is carried by one of the outlet valve head and the piston head) is positioned between the outlet valve head and the piston head so that when the other non-carrying one of the outlet valve head and the piston head comes in contact with and resiliently biases the outlet valve closing spring, the outlet valve is moved by the outlet valve closing spring from the maximum open position to the closed position ahead of the bump opening of the inlet valve.

Crank Assembly for Power Conversion

FIG. 1 shows a crank assembly 155 connected to piston 160 by power rod 195 in a conventional manner known in the art for converting reciprocating piston motion to rotary power output. Piston rings 164 as known in the art are shown. As shown in FIG. 1, this crank assembly is connected to motor-generator 188 so as to further convert the rotary mechanical power into electrical power as is well known in the art. Flywheel 185 is shown connected to the crank assembly 155 as is known in the art. Thus it is appreciated that flywheel is part of the crank assembly which is one type of periodic return means for effecting the return stroke of the expander after each power stroke. Because the flywheel is connected to the crankshaft which is operably connected to the piston head, rotational inertia of the flywheel may be transferred to the piston head via the crankshaft.

Starter Motor Generator

Motor-generator 188 is shown operably connected to the crankshaft and is preferably a squirrel cage induction motor compatible with the 60 Hz alternating current power in the United States. As is well known in the art, under low load conditions, such as when starting up, when connected directly to flywheel 185 as shown in FIG. 1, motor-generator 188 tends to cause the flywheel to rotate at a frequency very nearly equal to an integer fraction (with the integer depending on the motor pole structure) of the power grid frequency. As is known in the art, the precise rotational speed depends on the load on the motor, and the slip rate. When under load, the rotational speed lags the grid frequency and the motor-generator acts as a motor, while when being driven, the rotational speed is greater than the grid frequency, and the motor-generator acts as a generator. Common and inexpensive single-phase and three-phase induction motors are readily available for operation at 60 Hz (near 3600 rpm), 30 Hz (near 1800 rpm) and 20 Hz (near 1200 rpm). Where three-phase power connections are available, it is preferable to exploit a three-phase induction motor as the motor-generator. Where only single-phase power is available, a capacitor-start capacitor-run single-phase induction motor is preferred. Induction motors connected to an alternating current electrical power grid, when overdriven, produce power that is automatically properly phased with the power grid. As such, the motor-generator is capable of drawing power from a power grid to initially drive the expander at startup, and supplying power back to the power grid once operational.

Normal Engine Operation

Operation of the preferred engine embodiment is now described for normal, steady running conditions. The variation in the positions of the inlet valve, the outlet valve and the piston are shown with solid lines in a timing diagram in FIG. 6 as a function of the phase of the engine cycle. The pressure within the expansion chamber is indicated by dashed line 170 in FIG. 6. The normal engine cycle consists of a pair of strokes of the piston, starting at the TDC (Top Dead Center) position that corresponds to an angle of 0° for the crankshaft, with the piston at one extreme of it's motion nearest the top of cylinder 161, followed by a downward power stroke to the opposite extreme piston position at BDC (Bottom Dead Center), indicated by dashed line 142 in FIG. 6, followed by an upward recovery stroke back to the beginning point of the cycle at TDC. Under normal operation, the motion of the piston and valves are strictly periodic, and every cycle is nominally identical. As the pressure in the upper expansion chamber is higher on the down stroke from 0° to 180° than on the up stroke from 180° to 360°, averaged over a full cycle, the upper expansion chamber of the engine delivers a net positive power to the crankshaft.

Figure 3:
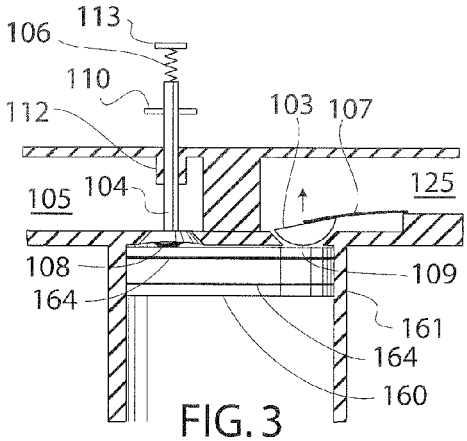
FIG. 3 is a cross-sectional view of the top portion of the first embodiment showing the piston at TDC position.
Figure 4:
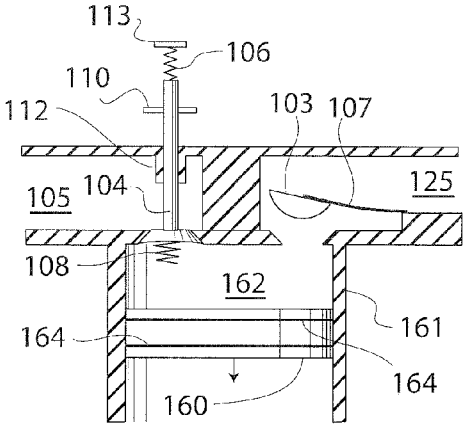
FIG. 4 is a cross-sectional view of the top portion of the first embodiment showing the inlet valve at its maximally open position.

Starting the cycle arbitrarily at the TDC position, the configuration of the components and the state of their motion is shown in FIG. 3, and is described as follows. Expansion chamber 162 is at its minimum volume point, preferably as small as is feasible. Piston 160 is instantaneously in a state of zero velocity as it is in the process of turning around. Outlet valve closing spring 108 is compressed to its smallest position and is exerting its strongest closing force on the outlet valve. Outlet valve 104 is fully closed and stationary. Inlet valve 101 is partially open and is moving upwards, as indicated by the arrow. Working fluid within expansion chamber 162 is at a pressure that is approximately equal to that of the supply pressure in the inlet header duct 125. The pressure difference between the working fluid in expansion chamber 162 and outlet header duct 105 produces a force on the outlet valve that is much greater than the force of outlet valve opening spring 106, and thus the outlet valve is held shut even without the extra force of outlet valve closing spring 108.

As piston 160 initially descends from TDC and the outlet closing spring 108 extends to its fully relaxed position, the outlet valve is held closed by the pressure difference between the working fluid in expansion chamber 162 and outlet header duct 105. At the same time, the inlet valve undergoes a single oscillation, passing upwards through the neutral position of spring 107 (as seen in FIG. 1, except that the outlet valve is closed and the inlet valve is moving upwards) to a maximally open position illustrated in FIG. 4. In the maximally open position, the inlet valve is instantaneously at rest before it returns towards its closed position. As the inlet valve completes the second half of its oscillating motion, it again passes through its neutral position (as seen in FIG. 1, except that the outlet valve is closed and the inlet valve is moving downwards), and finally, by virtue of the high Q of the inlet valve harmonic oscillation, just before the "closure point" indicated by arrow 140 in FIG. 6 arrives at the configuration illustrated in FIG. 5.

Figure 5:
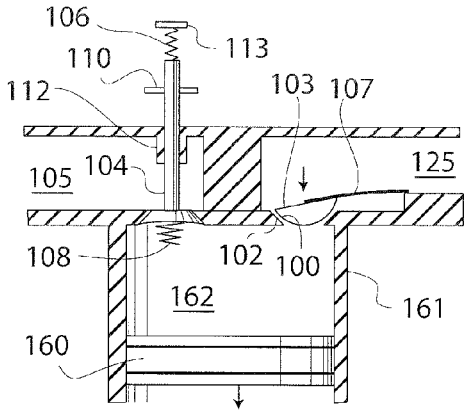
FIG. 5 is a cross-sectional view of the top portion of the first embodiment showing the inlet valve configuration just before it closes.

The state of motion of the components in FIG. 5 is as follows. The narrowest passageway for the inflowing working fluid is located at the annular shaped throat defined by the smallest gap between the surface of the frusto-spherical inlet valve head at 100 and the nearest portion of the frusto-conical seat 102. At this time the piston is moving down the cylinder, and the flow of working fluid through this narrow passageway becomes choked, and the pressure within expansion chamber 162 begins to drop significantly below the supply pressure in the inlet manifold. The pressure drop produces a force that urges the inlet valve to close. As the inlet valve gets very close to closing, under normal operating conditions, this pressure drop ensures that the inlet valve closes without bouncing, and remains closed for the remainder of the downward power stroke. This phenomenon is referred to as "dynamic latching" in this specification. The pressure drops when the rate of increase of the volume within expansion chamber 162 overwhelms the choked mass flow rate of working fluid through the narrow annular throat.

Figure 6:
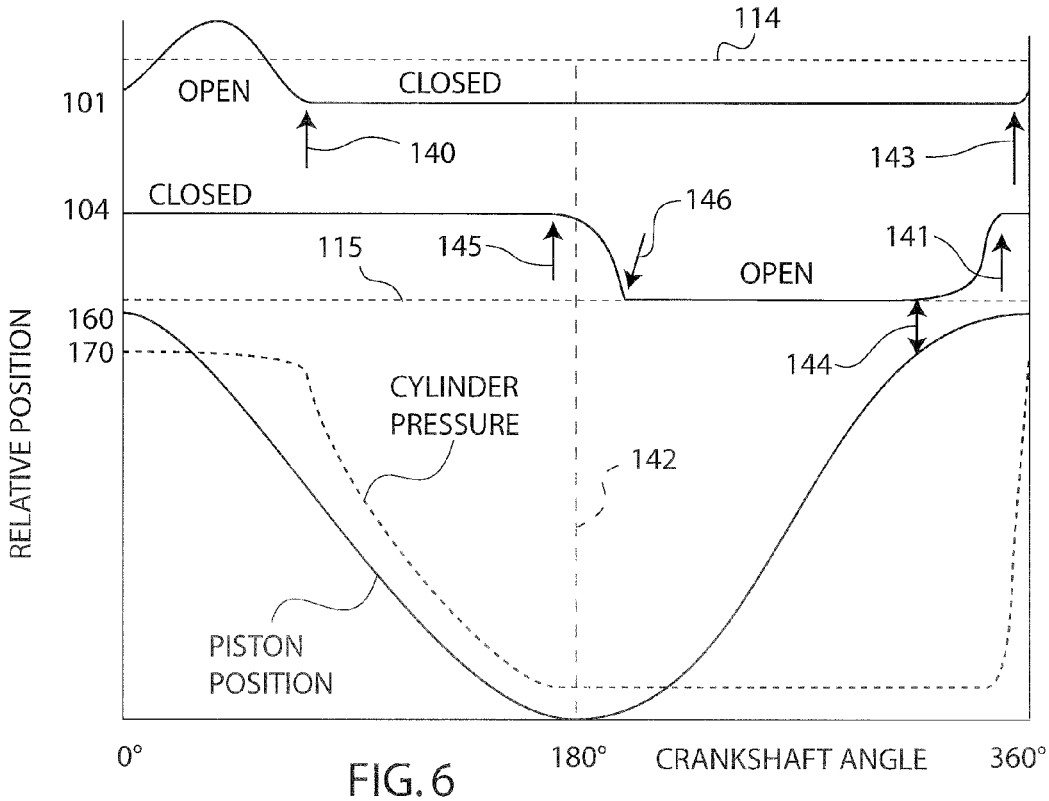
FIG. 6 is a timing diagram illustrating the relative positions of the upper inlet valve, upper outlet valve, the piston, and the pressure within the upper expansion chamber of the cylinder for nominal full power, full pressure operation.

After the inlet valve closes, at the phase indicated by arrow 140 in FIG. 6, the pressure in the expansion chamber drops approximately adiabatically as the volume of the working fluid within the chamber increases. Under nominal full power conditions, the pressure within the expansion chamber drops to very nearly equal the pressure of the working fluid in the exhaust header. At the moment that the force of the compressed outlet valve opening spring 106 exceeds the opposing force of the pressure drop across the outlet valve, the outlet valve begins to open. This point in the cycle is indicated by arrow 145 in FIG. 6. Once the outlet valve starts to open, the residual pressure drop between the expansion chamber and the exhaust header quickly decreases, and the outlet valve is forced by opening spring 106 to move rapidly toward its fully open position, indicated by dashed line 115 in FIG. 6.

As the piston reaches BDC, the outlet valve is in its initial stage of opening, and is moving downwards, towards the piston. Just after BDC, the piston is moving upwards, and the working fluid within the expansion chamber is forced out around the outlet valve. Near BDC, the piston speed is sufficiently small that the aerodynamic force of the outrushing working fluid produces only an insignificant fraction of the force produced by the outlet valve opening spring, and the outlet valve continues to open. The outlet valve is quickly brought to its fully open position 115, as determined by the location of stopper 110, at the point in the timing diagram indicated by arrow 146, and then remains there for most of the recovery stroke, as shown in FIG. 6. The impact of stopper 110 at the point that the outlet valve is fully closed is inelastic, and the outlet valve is brought to a sudden stop without bouncing. As an aid to prevent outlet valve bouncing, the outlet valve opening spring 106 is preferably still in compression at the fully open position of the outlet valve.

At the phase indicated in FIG. 6 by arrow 144, the piston makes initial contact with outlet valve closing spring 108. As the piston continues towards TDC, the outlet valve closing spring is compressed and the outlet valve accelerates towards its closed position. At the phase indicated by arrow 141, the outlet valve is closed. With proper choice of spring constants, the outlet valve closure occurs just before the piston makes contact with the bottom of the inlet valve 109 and forces open the inlet valve. This event is indicated by arrow 143 in FIG. 6.

During the portion of the cycle between the phases indicated by arrows 141 and 143, with the outlet valve closed and stationary and the inlet valve not yet open and also stationary, the working fluid is getting compressed, and its pressure increases due to the upward motion of the piston. With the proper choice of spring strengths, the working fluid pressure is preferably approximately equal to the full value of the pressure in the inlet header at the time that the bottom of the inlet valve 109 makes contact with piston 160. Once the inlet valve is forced open, however, as the remaining volume within the expansion chamber is minimal, whatever the pressure in the expansion chamber immediately prior to the opening of the inlet valve, the pressure in the expansion chamber very rapidly equalizes with the pressure of the supply.

If the working fluid pressure has not risen to match the supply pressure, the physical contact of piston 160 against the bottom of the inlet valve 109 provides sufficient impulse to force the opening of the inlet valve. On the other hand, if under off-nominal circumstances, the cylinder pressure has increased to well above the supply pressure, then the pressure force on the inlet valve, together with the inlet valve spring 107 act together to open the inlet valve and relieve the excess pressure. Because of this, the inlet valve acts as a safety valve, and this engine is quite tolerant of off-nominal conditions.

Under nominal, full power, steady operation, with the pressure in the expansion chamber nearly matching the supply pressure, the impact of piston 160 against the bottom of the inlet valve 109 is very mild or even non-existent in the case that the vanishing pressure drop allows inlet valve spring 107 to open the inlet valve prior to piston 160 making contact with the inlet valve. In any case, under steady running conditions, the state of all components at 360° of phase angle is identical to that described above for 0° of phase angle, and the engine cycle repeats.

Startup of Engine

With the application of high pressure working fluid to the inlet header manifold, and with a design choice that the outlet valve opening spring is stronger than the inlet valve opening spring, the aerodynamic force of working fluid flowing first past the inlet valve, then into the expansion chamber, and finally out past the outlet valve, the inlet valve is forced closed before the outlet valve has a chance to close. This aerodynamic force is much greater than the choked flow force that develops under normal running conditions just before the phase point indicated by arrow 140 in FIG. 6. With approximately equal area apertures for the inlet and outlet valves, and thus approximately equal flow resistance from the inlet duct 125 to the expansion chamber 162 as from the expansion chamber 162 to the exhaust duct 105, with both inlet and outlet valves initially open, the pressure drop across the inlet valve approximately matches the pressure drop across the outlet valve.

As a result, the expansion chamber remains at the pressure of the exhaust header manifold, and there is no significant load on the piston. Because of this, with the induction motor/generator subsequently connected to a source of AC electrical power, it can rapidly come up to its unloaded rotational speed. As the piston encounters the open outlet valve on its first upstroke at less than full speed, outlet valve closing spring 108 assures that valve 104 will be closed prior to piston 160 making contact with inlet valve 101, and as a result the pressure within expansion chamber 162 will be brought to its nominal value under full speed conditions, and inlet valve 101 is forced to open. The high Q of the harmonic oscillator inlet valve assembly assures that inlet valve 101 returns very nearly to its fully closed position after the inlet valve undergoes a single cycle of oscillation. Because of the narrow opening after a single oscillation of the inlet valve, even the slower speed (at startup) descent of piston 160 suffices to produce a dynamic latching of inlet valve 101 in its closed position by virtue of the choked flow of the working fluid through the converging-diverging nozzle formed between the frusto-spherical surface of the inlet valve head 103 and the conical surface of the inlet valve seat 102. As a result, the pressure is assured to decrease to that of the outlet manifold, and outlet valve 104 is assured to open by the process described in the following paragraph. Thus after such a cycle, the rotational speed of flywheel 185 increases, until after one or more (depending on the moment of inertia of the flywheel) such startup cycles, the flywheel accelerates to its normal operating speed and the pressure and flow conditions are those of full running power conditions, and normal operational cycles begin. As the engine produces power, it overdrives motor 188, and instead generates electrical current that is forced to be in phase with the electric grid current by the nature of induction motors. With a sufficiently high moment of inertia flywheel, the angular velocity of the flywheel becomes almost constant, and the alternating current power generated is almost perfectly steady.

Low Pressure Operation

Figure 7:
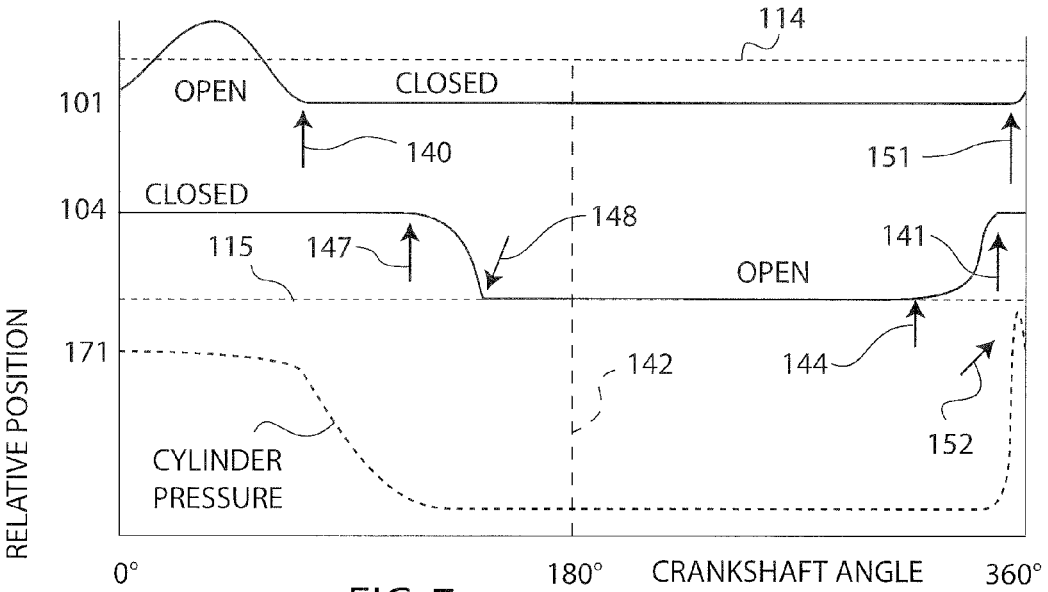
FIG. 7 is a timing diagram for operation at reduced pressure and power.

The operation of the harmonic engine under conditions that the supply pressure is less than the nominal full power design pressure is shown in FIG. 7. Almost all of the events described in connection with full pressure operation in FIG. 6 are unchanged, except that, as the pressure of the working fluid admitted to the expansion chamber is less, following the closing of the inlet valve at the point indicated by arrow 140, the expansion of the working fluid causes its pressure 171 to drop to the level required to open the outlet valve at an earlier phase of the engine cycle. The earlier start of the opening of the outlet valve is indicated by arrow 147 in FIG. 7 and the earlier completion of the opening of the outlet valve is indicated by arrow 148. The start of the closing of the outlet valve, as it is driven by the position of the piston, still occurs at its normal phase point shown by arrow 144, and the complete closure, shown by arrow 141 occurs at its normal time. However, since the pressure in the inlet header duct 125 is less than the full power design pressure, the pressure within expansion chamber 162 tends to approach the full power design pressure, and may even "overshoot" the pressure in the inlet header duct as indicated by arrow 152 in FIG. 7, and thus tends to begin to force open inlet valve 101 very slightly earlier than normal, as indicated by arrow 151 in FIG. 7.

As a result, the outlet valve is open for a longer time during low-pressure operation and the inlet valve opens slightly earlier but stays open for approximately its normal duration. The ramification of operation at lower pressure is simply that the power output is less for a given speed of operation while the relative efficiency of operation is maintained. Lowering the supply pressure thus provides a convenient means to adjust to a lower power load requirement.

A very similar process is found during the startup of the harmonic engine described above, in that, at low rotational speed, the open period of the inlet valve, which is approximately a constant time interval, spans a shorter range of crankshaft phase angle, and thus the cylinder pressure drops to that of the outlet manifold earlier in phase, and the outlet valve is sprung open at an earlier phase angle as well. The outlet valve remains open for a longer span of crankshaft phase angle, but is closed by spring 108 at the normal phase by virtue of contact with piston 160 on its rise towards TDC.

It is by virtue of these processes that the valve timing is variable and self adjusts to accommodate a wide range of supply pressure conditions in a nearly optimal way relative to what is thermodynamically possible.

Self-Governed Operation

In a variation of the first embodiment in which the crankshaft is not connected to a motor generator, but is instead used to supply rotational mechanical power to a load, the operational frequency is not held fixed by the induction motor/generator. In such applications, adjustment of the position of outlet valve opening spring support 113 allows adjustment of the crankshaft phase angle at which outlet valve 104 closes. Various devices or methods known in the art may be employed for adjusting the equilibrium restoring force exerted by the resiliently biasing member of the outlet valve so as to adjust a crankshaft phase angle at which the outlet valve closes. Specifically, with support 113 lowered, the compression of spring 106 is increased, and the closing phase for outlet valve 104 is delayed. Conversely, with support 113 raised, the closing phase for the outlet valve is advanced. Change in the phase of the outlet valve closure allows adjustment of the maximum pressurization within the expansion chamber as the piston approaches TDC. This adjustment enables adapting the engine for maximum efficiency operation even while running at a wide variety of speeds.

Excessive Pressure Operation

The operation of the harmonic engine of the first embodiment with excessive pressure leads to a tendency for a decrease in power output relative to normal operating conditions. If the cylinder pressure at BDC has not decreased sufficiently through the expansion process to allow the outlet valve to open, then the subsequent upstroke of the engine simply recompresses the working fluid in the cylinder, and positive work is not produced during such a cycle. However, during such a recompression stroke, the inlet valve then tends to open early, by virtue of the much greater than normal pressure in the expansion cylinder as the piston approaches TDC, and as a result the next cycle can produce some positive work. The work done under such a cycle is less than normal, as the pressure induced opening of the inlet valve tends to be early, which tends to lead to an early closure of the inlet valve.

As a result, when driven by excessive pressure, the net power averaged over several cycles is decreased. This feature can be used to advantage under some circumstances, such as providing a self-governing operational mode.

Reversibility

The operation of the harmonic engine of the first embodiment is insensitive to the direction of rotation of the crankshaft, and thus it runs equally well with a clockwise or counter-clockwise rotation. Starting from rest, if the piston is just below TDC, with the crank at a positive angle of 10°, for example, and pressurized working fluid is supplied to the inlet port of the engine with a pressure sufficient to overcome static friction, the piston will begin to move downwards and the crankshaft will rotate in a positive direction and continue to run in a positive direction. On the other hand, if the crank starts at a negative angle of −10°, the piston will be the same distance from TDC, and will begin to move downwards, and the engine will run "backwards" with the crankshaft rotating in a negative direction.

Second Example Embodiment

Figure 8:
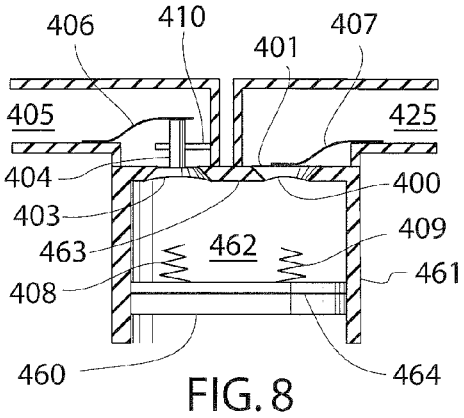
FIG. 8 is a cross-sectional view of the upper section of the second embodiment showing both inlet and outlet valves in closed position.
Figure 9:
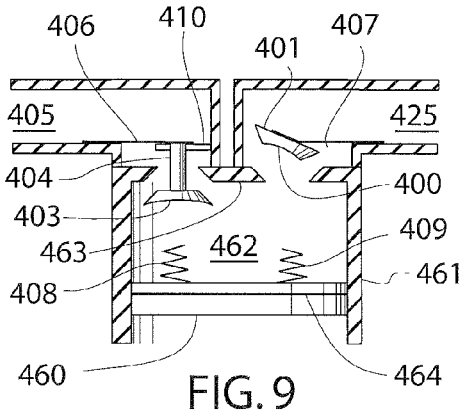
FIG. 9 is a cross-sectional view of the upper section of the second embodiment showing the inlet and outlet valves in their relaxed, equilibrium positions.

An embodiment that provides for greater accommodation to higher-pressure and higher speed operation is shown in FIGS. 8 and 9. FIG. 8 shows both inlet and outlet valves in their closed position. FIG. 9 shows both inlet and outlet valves in their quiescent neutral positions prior to startup of the engine. In this embodiment, there are two key modifications to the first embodiment described above. The first is that the function of the rigid inlet valve lower surface 109 of the first embodiment is replaced with a spring 409 or otherwise resilient, compliant or elastic member. The second is that the inlet valve is made sufficiently low in mass that the aerodynamic forces are no longer insignificant relative to the spring forces when the inlet valve is in its equilibrium position or higher, as is inherent in the discussion of the first embodiment above. Part of this mass reduction is affected by the removal of the lower frusto-spherical portion of the inlet valve head. In addition, the valve head may be made hollow to further lighten it.

Inlet valve launching spring 409 is shown mounted on piston 460 in order to help minimize the mass of the inlet valve assembly, although it could be mounted on valve 401 as well. Inlet valve 401 has a dished lower surface 400 that accommodates space for spring 409 to be compressed and allows piston 460 to rise to nearly contact the top surface 463 of cylinder 461 and thus minimize the minimum volume of expansion chamber 462. It is appreciated that a recess in the upper surface of the piston could serve this role as well. In contrast to the first embodiment, in which the lower surface of the inlet valve 109 forces the inlet valve to open immediately after surface 109 makes contact with piston 160, the compliance of spring 409 does not open inlet valve 401 immediately after contact.

In this embodiment, the inlet valve opening spring is implemented as a flexure spring 407 mounted to the internal wall of inlet duct 425. Outlet valve opening spring is also implemented as a flexure spring 406 mounted on the internal wall of outlet header duct 405, with the maximum opening position limited by a stopper 410. Outlet valve closing spring 408 is mounted to the upper surface of piston 460 and nestles within the dished surface 403 of outlet valve 404 when it is fully compressed. In this embodiment, the piston sealing element is preferably at least one unitary ring or flange 464 as known in the art, that not only provides for low friction bearing of the piston but also a hermetic seal against leakage of working fluid within expansion chamber 462 past piston 460. With all structures of the inlet valve located within the inlet header duct 425 and all structures of the outlet valve located within the outlet header duct 405, and with piston sealing ring 464 a unitary seal, the engine eliminates significant leakage of working fluid to the outside environment during its normal operation.

The relative heights of the relaxed outlet valve closing spring 408 and the relaxed inlet valve launching spring 409 together with the relative spring constants are chosen so that outlet valve 404 is closed by the compression of spring 408 prior to piston 460 reaching TDC and prior to the opening of inlet valve 401 by the compression of launching spring 409. The height of inlet valve opening spring 409 is chosen greater than the distance between the top of piston 460 and the top surface 463 of the cylinder at the time that outlet valve 404 just closes, so that launching spring 409 becomes compressed as piston 460 approaches TDC.

Generally therefore, this embodiment also includes the reciprocating-piston expander comprising: the expander cylinder having an inlet and an outlet; the piston head axially slidable in the expander cylinder and together enclosing an expansion chamber accessible by the inlet and the outlet, the intake header in fluidic communication with the inlet for channeling working fluid from a pressurized fluid source into the expansion chamber, and the exhaust header in fluidic communication with the outlet for channeling working fluid exhausted out from the expansion chamber. And also similar to the first embodiment, an inlet valve is also provided for controlling the flow of working fluid from the intake header through the inlet to effect a power stroke of the expander, with the inlet valve comprising an inlet valve head and a resiliently biasing member arranged together as a harmonic oscillator so that the inlet valve head is moveable against an equilibrium restoring force of the resiliently biasing member from an unbiased equilibrium position located in the intake header to a biased closed position occluding the inlet. Arranged in this manner, upon releasing the inlet valve head from the closed position, it undergoes a single oscillation past the equilibrium position to an oppositely biased maximum open position and returns to a biased return position between the closed and equilibrium positions to choke the flow of working fluid and produce a pressure drop across the inlet valve causing the inlet valve to close.

Also the outlet valve of the second embodiment is provided to control the flow of working fluid exhausted out through the outlet to the exhaust header during a return stroke of the expander. As discussed the outlet valve includes an outlet valve head, stopper, and a resiliently biasing member arranged so that the outlet valve head is moveable against an equilibrium restoring force of the resiliently biasing member from a maximum open position located in the expansion chamber and delimited by the stopper to a biased closed position occluding the outlet.

And generally, the second embodiment of FIGS. 8 and 9 show the use of a first protrusion carried by one of the inlet valve head and the piston head and positioned therebetween so that when the other non-carrying one of the inlet valve head and the piston head comes in contact with the protrusion the inlet valve is bumped open from the closed position to initiate the single oscillation of the inlet valve head. In particular the first protrusion in FIGS. 8 and 9 is shown as a spring carried by the piston head. For the outlet valve, an outlet valve closing spring is carried by one of the outlet valve head and the piston head and positioned therebetween so that when the other non-carrying one of the outlet valve head and the piston head comes in contact with and resiliently biases the outlet valve closing spring the outlet valve is moved by the outlet valve closing spring from the maximum open position to the closed position ahead of the bump opening of the inlet valve. And while not shown in FIGS. 8 and 9, a periodic return means similar to FIGS. 1-5 is operably connected to the piston head for effecting the return stroke of the expander after each power stroke.

Normal Operation of Second Example Embodiment

The operation of the second embodiment under nominal or lower pressure conditions is very much as described above for the first embodiment. The minimal volume of the expansion chamber at TDC, dictates that the amount of working fluid that must be admitted through the inlet valve to raise the pressure within the cylinder to that of the supply is minimal, and the pressure jump as the piston approaches TDC can be achieved in minimal time. This is advantageous for achieving higher efficiency and power.

High Pressure Overdrive Operation

Figure 10:
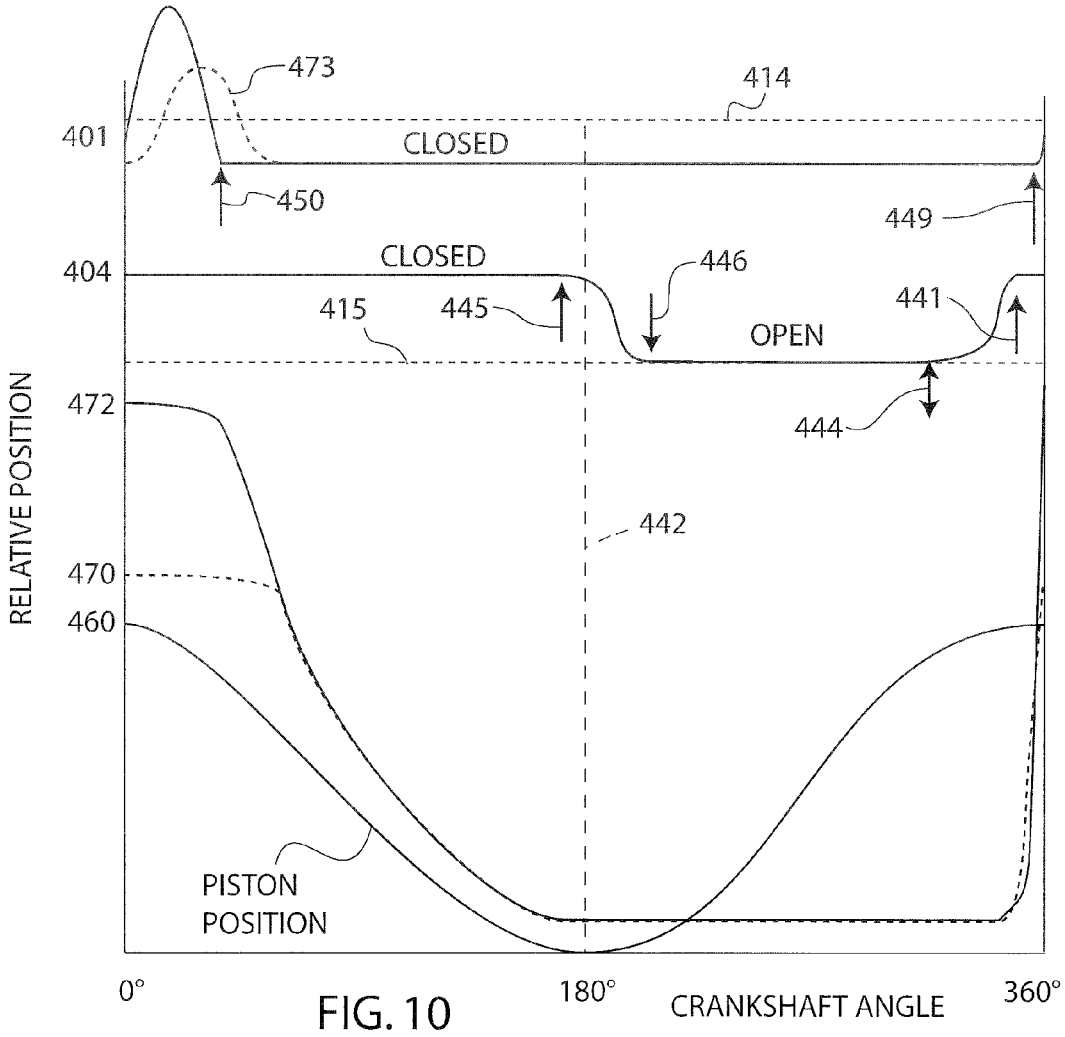
FIG. 10 is a timing diagram for overdrive operation at high pressure.

The operation of the second embodiment under high supply pressure conditions changes significantly, and the contrast with nominal pressure operation is shown in FIG. 10. In this figure, the motion of inlet valve 401, outlet valve 404, piston 460 and cylinder pressure 472 are shown as a function of crankshaft angle. The motion of the inlet valve for a single cycle of free oscillation (neglecting aerodynamic forces and assuming a sufficiently high Q that damping is negligible for a single cycle) starting from TDC is shown for comparison by dashed line 473, and the pressure in the expansion chamber for nominal conditions is shown for comparison by dashed line 470.

The highest efficiency in the extraction of the energy of the supplied pressurized working fluid is obtained with the complete expansion down to the pressure of the working fluid in the exhaust manifold 405 occurring just as the piston reaches BDC. Under these conditions, the outlet valve opens at a phase point shown by arrow 445 just before BDC shown by dashed line 442, and is completely open at phase point indicated by arrow 446. The pressure in the expansion chamber after the closure of the inlet valve and before the re-opening of the inlet valve is virtually the same for both high pressure and normal pressure conditions, as shown in FIG. 10. With a higher-pressure supply of working fluid, the compression of inlet valve launching spring 409 is greater prior to the opening of inlet valve 401, and thus the stored potential energy is greater. Furthermore, as the density of higher-pressure supply of working fluid is greater, the aerodynamic force of inrushing working fluid is greater than for normal operating conditions. Once inlet valve 401 opens, at the phase indicated by arrow 449 just before TDC, due to the combination of the upward force of compressed launching spring 409, flexed opening spring 407 and the compression of the working fluid in the expansion chamber produced after outlet valve 404 closes at the phase indicated by arrow 441, the pressure differential across inlet valve 401 rapidly disappears, and the potential energy stored in launching spring 409 is converted to kinetic energy of the upward velocity of valve 401. As a result, the motion of the inlet valve undergoes less than a full cycle of unrestrained, free oscillation, as can be seen by the comparison of the solid curve for valve 401 and the dashed curve 473 that represents a complete cycle of free oscillation, and the inlet valve moves further beyond neutral position 414 than in the nominal pressure case. As a result of the decreased time that inlet valve 401 is open, the initially higher-pressure working fluid experiences a greater degree of expansion. With careful design, it has been found that a factor of approximately two greater working fluid pressure beyond normal can be accommodated by this embodiment without significantly altering the phase that the outlet valve opens and thus without loss of nearly optimal expansion efficiency.

Finally, with even greater than a factor of two overdrive pressure, if the mass of inlet valve 401 is made sufficiently light, the aerodynamic force of the inrushing working fluid can drive inlet valve closed in even less time than half the natural resonance period of the freely oscillating inlet valve. In practice a prototype engine has achieved as much as a factor of four decrease in the open period of a harmonic engine inlet valve with respect to its natural resonance period. This prototype engine had a cylinder bore of 7 cm, a stroke of 4.4 cm, both inlet and outlet valve port diameters of 1.5 cm, a mass of 11 g for the outlet valve, a mass of 7 g for the inlet valve, a spring constant of 590 N/m for the outlet valve opening spring, and a spring constant of 170 N/m for the outlet valve closing spring. The natural resonance period of the inlet valve was approximately 0.02 s, with the engine operating at low pressure and a cycle time of 0.05 s. As the pressure increased, the open period of the inlet valve decreased to as little as 0.005 s. This prototype engine was able to run satisfactorily over the range of supply pressures from 3 psig to 43 psig.

The advantage of such overdriven inlet valve operation is that much higher efficiency of use of the pressurized working fluid over a wider range of supply pressures is made possible relative to the case without overdrive.

Third Example Embodiment

Figure 11:
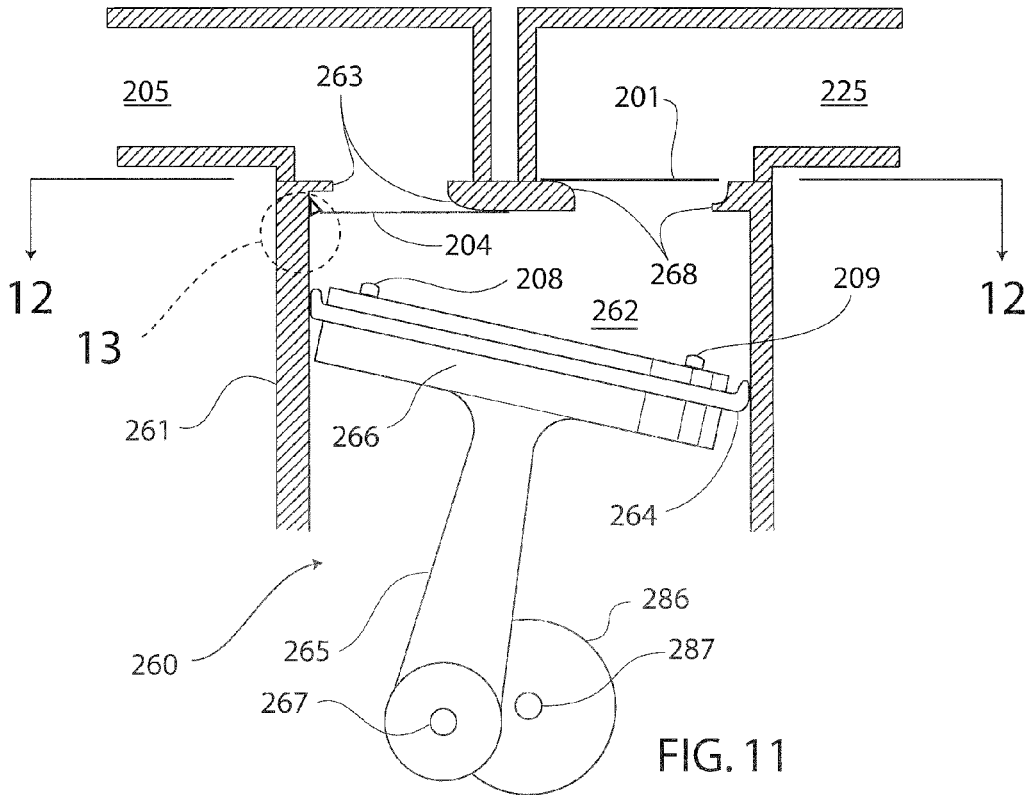
FIG. 11 is a side cross-sectional view of the wobble-piston embodiment.
Figure 12:
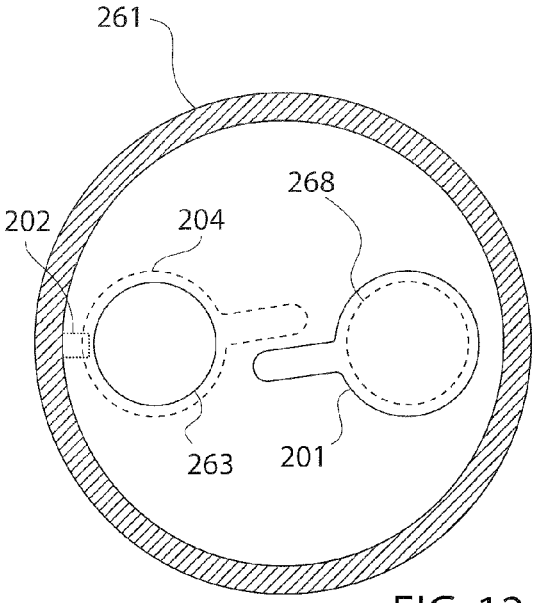
FIG. 12 is a top cross-sectional view showing the inlet and outlet valves with a portion of the cylinder and the outlet valve latch, taken along the line of sight 12-12 shown in FIG. 11.
Figure 13:
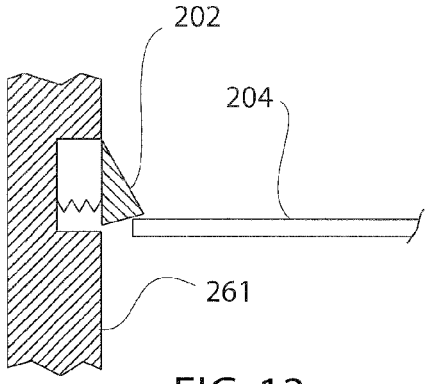
FIG. 13 is an expanded view showing the details of the outlet valve latch mechanism, taken from the portion of FIG. 11 within circle 13.

A third embodiment, shown in FIGS. 11 through 13, exploits the use of a wobble-piston 260, known in the art. The wobble-piston comprises a piston head 266 and a connecting rod 265 that are either rigidly attached or cast as a single unit. At one end of the connecting rod a crank pin 267, mounted off-center on eccentric drive 286 moves in a circle about the center of crankshaft 287. The piston head 266 is kept centered within cylinder 261 by a flexible ring, flange or cup 264 that both seals working fluid within expansion chamber 262 and provides a low-friction bearing between the piston and the cylinder. As the crankshaft turns, the wobble piston tilts back and forth as it moves up and down within the cylinder. The mechanism of the wobble piston described in this paragraph is known in the art.

In this embodiment of the harmonic engine, inlet valve 201 is in the form of a reed valve, shown from the side in FIG. 11, and from above in FIG. 12. Inlet valve 201 is open when in its fully relaxed position, as shown in FIG. 11, and closed when held down against inlet port 268 by the difference in pressure between inlet header duct 225 and the expansion space 262. Outlet valve 204 is also in the form of a reed, also normally open in its fully relaxed position. The outlet valve is closed when held up against outlet port 263 by either spring forces or the difference in pressure between outlet header duct 205 and the expansion chamber 262.

With the very low mass characteristic of reed valves, it is preferred to incorporate a latching mechanism, as shown in FIG. 13, that prevents the outlet reed valve 204 from closing prematurely in the face of the aerodynamic force of the outrushing working fluid from expansion space 262 past the outlet valve 204 and through the outlet port 263 to the exhaust header duct 205. The outlet valve latch 202 is configured to allow the outlet valve to easily pass the latch position while moving downwards, but requires a greater force to become released while moving upwards. This greater force is provided by outlet valve closing rigid protrusion 208 that presses against the outlet reed valve 204 as the wobble piston moves towards TDC. A rigid protrusion 209 on the piston presses against the inlet reed valve 201 to force it open just at TDC.

Reed valves, firmly supported, have low friction, and thus readily provide the high Q resonant behavior desirable in the present engine. Reed valves are also naturally low in mass, which is conducive to high-speed operation as well. The springiness of the reeds provides the resilient action described for the prior embodiments without the need for a separate resilient member.

Operation of Third Example Embodiment

The feature of the wobble-piston that is exploited here is that the left hand side of the piston (as shown in the drawings herein) reaches the apogee of its motion towards the top of the cylinder before the right hand side of the piston reaches its apogee, and before the middle of the piston reaches its apogee. Furthermore, the right hand side of the piston reaches its apogee after the middle of the piston. Note that the height of apogee of the left hand side of the wobble piston is above the height of apogee of the center of the wobble piston.

In normal operation, the protrusion 209 on the wobble-piston serves to force inlet valve 201 to open at a phase angle just at or slightly after TDC. Although it is appreciated that this protrusion could be compliant or elastic, as described for the second embodiment, with a rigid protrusion, the phase of opening of the inlet valve is well defined, and independent of the magnitude of the supply pressure. Once forced open, and with the pressure in expansion chamber 262 equalized with the supply pressure, inlet valve 201 undergoes a single oscillation, and is then held closed by the pressure differential that develops across it, just as described above for the first embodiment. Having a rigid protrusion 209 helps keep the low mass inlet valve 201 from being unduly influenced by the rapidly inrushing working fluid just after it opens.

In normal operation, the outlet valve remains closed from TDC to just before BDC, until the pressure within the expansion chamber decreases to nearly that of the outlet manifold, at which point the outlet reed rapidly snaps opens and is stopped at its fully relaxed, neutral position by latch 202.

Both the inlet and outlet valves remain in these positions, the inlet closed and the outlet opened, for most of the upstroke of the wobble-piston. As the wobble-piston approaches TDC, it is tilted, and its left hand side is closer to the top of the expansion chamber than its right hand side. Thus, the preferred time ordering of the closing of the outlet valve before the inlet valve is opened is easily achieved by positioning the outlet valve over the portion of the wobble-piston that arrives at the upper extreme of its travel earlier. A protrusion 208, that may be rigid, elastic, compliant or springy, is located on the left hand side of the wobble-piston. As the outlet valve closing protrusion 208 makes contact with the outlet valve and begins to close it, the piston has not yet reached TDC, and thus the volume of the expansion space is decreasing. As the outlet valve is forced closed by protrusion 208, the increasing pressure (by virtue of the decreasing volume) within the expansion chamber in combination with the compression (if compliant) of protrusion 208 serve to hold the outlet valve closed. With the outlet valve closed, the piston continues to TDC and the cycle repeats. A particular virtue of the wobble-piston embodiment is the natural enforcement of the closure of the outlet valve prior to TDC, and the opening of the inlet valve after TDC by the natural wobbling nature of the motion of the piston.

Timing of Third Example Embodiment

Figure 14:
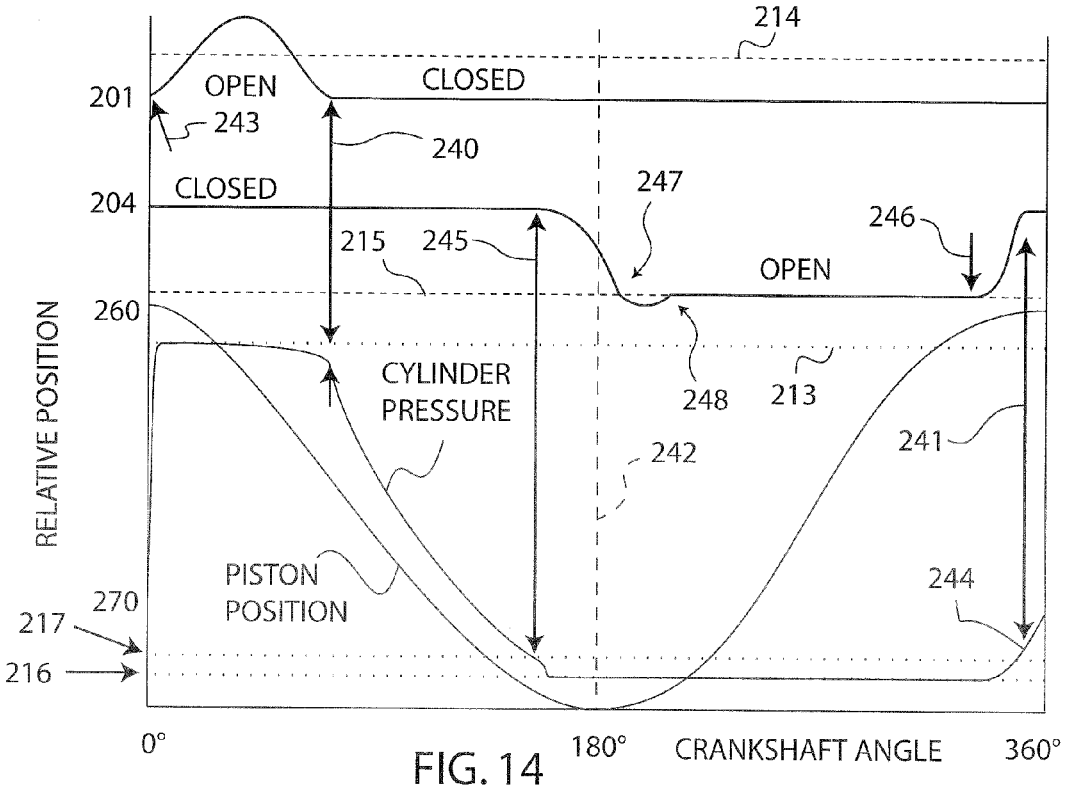
FIG. 14 is a timing diagram for the wobble-piston embodiment.

A timing diagram for the wobble-piston embodiment is displayed in FIG. 14. Curves in this figure show the relative positions of the inlet valve, the outlet valve and the center of the top of the wobble-piston. The pressure 270 within expansion chamber 262 is also displayed as a function of the crankshaft angle. Starting at 0° in this cycle, the wobble piston motion is such that the phasing of the opening of inlet valve 201, shown by arrow 243, may be designed to coincide precisely with the TDC piston of the wobble position. In contrast to a purely axially moving piston, in which the instantaneous velocity of the piston vanishes at TDC, for the wobble-piston, the instantaneous velocity of the right hand side, bearing the inlet valve opening protrusion, does not vanish at TDC. This important distinction allows precise and reliable timing of the opening of the inlet valve. Then, in the initial portion of the inlet valve opening cycle, just after TDC, the inlet valve is forced, by the continuing upward motion of inlet valve launching protrusion 209, to continue opening even against the strong aerodynamic force of the rapid inlet flow of high pressure working fluid. This turbulent aerodynamic flow could otherwise interact with the opening of a low mass inlet reed valve in a deleterious way. Once the expansion chamber is filled with high pressure working fluid, the force of the aerodynamic flow greatly lessens, and inlet reed valve 201 completes a cycle of oscillation without significant aerodynamic counter forces until just before closing. Immediately after inlet valve 201 opens, the pressure 270 rapidly increases to the level 213 of the pressurized supply of working fluid. While the inlet valve is far from its closed position, flow between inlet header duct 225 and expansion chamber 262 is relatively unrestricted and the expansion chamber pressure remains near the supply pressure. As the inlet valve returns to near its closed position, not only is the instantaneous velocity of piston 260 substantially negative, thus causing a rapid flow of working fluid past the inlet valve, but the area of the aperture, defined by the position of inlet valve 201, between inlet header duct 225 and expansion chamber 262 becomes small, leading to a pressure drop between the inlet header pressure and the expansion chamber pressure. By design, this pressure drop at the moment the inlet valve reaches its closed position, indicated by arrow 240 in FIG. 14, is sufficient to hold the inlet valve closed. After the inlet valve is closed, the pressure in the expansion chamber drops until the point indicated by arrow 245 where the pressure has reached the level indicated by arrow 217 for which the pressure differential across the outlet valve just matches the spring force tending to open the outlet valve. Once the outlet valve begins to open, this pressure differential rapidly decreases until it reaches the level indicated by arrow 216 corresponding to equalization with the pressure in the exit header duct 305, as shown in FIG. 14, and the outlet valve rapidly accelerates. Then, at the point indicated by arrow 247, the outlet reed passes latch 247, and may overshoot its designed open position 215, as shown in FIG. 14. However, by the design of latch 202, outlet reed 204 has insufficient momentum to be able to pass by the latch in the upward direction and is brought to a stop at the point indicated by arrow 248. The outlet valve remains open until the point indicated by arrow 246 that the outlet valve closing protrusion 208 mounted on the left hand side of the wobble piston encounters outlet reed valve 204, and the outlet reed begins to accelerate towards its closed position. Since the apogee of the left-hand side of the wobble-piston occurs before TDC, the outlet valve is readily forced closed by protrusion 208 at a phase prior to TDC, as shown by arrow 241. By virtue of the increase in the pressure shown by numeral 244 in FIG. 14, above the level 217, at the point indicated by double arrow 241, the outlet reed is held closed until TDC is reached, and the inlet reed valve is forced open and the cycle can begin again.

Irreversibility of Third Example Embodiment

In contrast to the first two embodiments, the wobble-piston embodiment is not symmetrical in its operation with respect to the direction of rotation of the crankshaft. Since the inlet valve is forced open after the inlet valve is forced closed for one direction of rotation but not the other, the wobble-piston engine operates best in that direction, and may not work at all in the opposite direction. Also, as the inlet valve is forced open by protrusion 209 over a wider range of crankshaft angles, and with proper design these may all be positive angles, the startup conditions for the wobble-piston embodiment are more tolerant of variations in the engine speed and operating pressure. For example, with a wobble-piston connecting rod length of 12.7 cm, an eccentric radius of 1.8 cm, and a piston width of 7.2 cm, then the height of the right hand side of the piston increases from its position at 0° where it is at the same height as the center of the piston at TDC, reaches a maximum position that is higher by 0.64 mm at a crankshaft angle of 14° and then returns to the height of the piston at TDC when the crankshaft is at 28°. Thus if the protrusion 209 makes initial contact to open the inlet valve at 0°, then it will force the inlet valve to remain open over the range of angles from 0° to 28°, regardless of the engine speed or supply pressure.

Aircraft Embodiment

Figure 15:
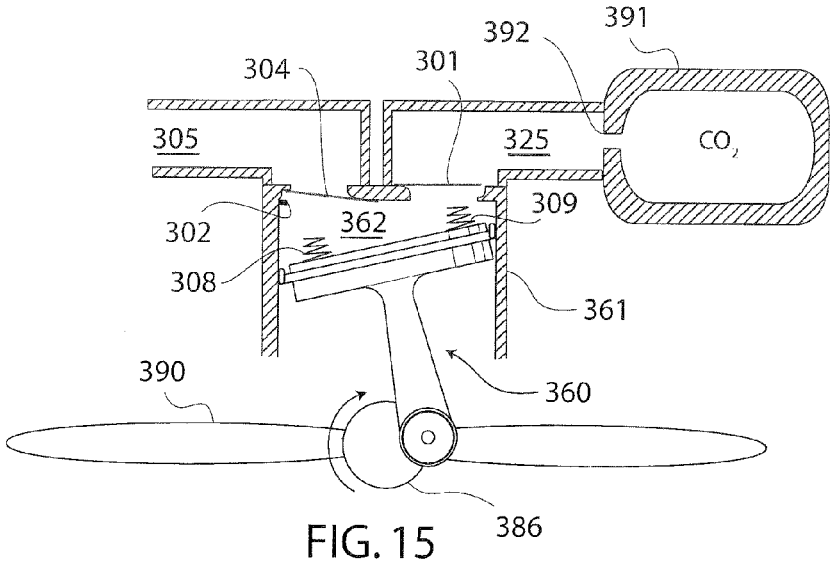
FIG. 15 is a cross-sectional view of an aircraft embodiment of the present invention.

An especially lightweight and efficient embodiment of the harmonic engine especially useful in the context of an aircraft engine, is shown in FIG. 15. Here a propeller 390 driven by eccentric drive 386 of a wobble-piston 360 not only serves in place of the flywheel for the harmonic engine by virtue of its natural large moment of inertia, but also is directly powered by the engine to provide aircraft propulsion. The use of a reed inlet valve 301, opened by a launching spring 309 and a reed outlet valve 304, closed by spring 308 provides such a desirably low-mass engine. Outlet valve stopper 302 implemented as a small protrusion on cylinder 361 is also very simple and lightweight. In the aircraft case, the exhaust duct 305 vents directly to ambient air, while the inlet header duct 325 is connected to a throttle valve 392 that provides a supply of gas from high-pressure gas cylinder 391. For small model aircraft, cartridges of $CO_2$ provide a readily available and convenient source of high-pressure gas.

Thus this example embodiment is also an engine having a reciprocating-piston expander operably connected to a crank assembly. In particular, and similar to the other embodiments discussed herein, the expander includes an expander cylinder having an inlet and an outlet, an intake header in fluidic communication with the inlet for channeling working fluid from a pressurized fluid source into the expansion chamber, and an exhaust header in fluidic communication with the outlet for channeling working fluid exhausted out from the expansion chamber. In this embodiment, however, a wobble piston is used having a piston head with a flexible flange positioned between the piston head and the expander cylinder so as to seal an expansion chamber enclosed by the piston head and the expander cylinder and which is accessible by the inlet and the outlet. The piston head is connected to the crank assembly via a fixed connected piston rod. Also, an inlet reed valve is used for controlling the flow of working fluid from the intake header through the inlet to effect a power stroke of the expander.

Here too, the inlet reed valve is a harmonic oscillator with a first end connected to a wall of the intake header and a second end moveable to a closed position by resiliently biasing the inlet reed valve against an equilibrium restoring force thereof from an unbiased equilibrium position located in the intake header to a biased closed position occluding the inlet. In this manner, and upon releasing from the closed position, the second end of the inlet reed valve undergoes a single oscillation past the equilibrium position to an oppositely biased maximum open position and returns to a biased return position between the closed and equilibrium positions to choke the flow and produce a pressure drop across the inlet valve causing the inlet valve to close.

And an outlet reed valve is used for controlling the flow of working fluid exhausted out through the outlet to the exhaust header during a return stroke of the expander. Like the inlet reed valve, the outlet reed valve has a first end connected to a wall of the expansion cylinder and a second end moveable to a biased closed position occluding the outlet by resiliently biasing the outlet reed valve against an equilibrium restoring force thereof from an open position located in the expansion chamber. As discussed above, the outlet valve latch operates to latch the second end of the outlet reed valve in the open position. And two protrusions are carried by the piston head, which are positioned to bump open the inlet valve from the closed position to initiate the single oscillation of the second end of the inlet reed valve, and to release the second end of the outlet reed valve from the outlet valve latch and move the second end of the outlet reed valve from the open position to the closed position ahead of the bump opening of the inlet valve The crank assembly of the third example embodiment has a crankshaft operably connected to the piston rod for effecting the return stroke of the expander after each power stroke, and inducing wobble motion of the piston head as it reciprocates in the expansion cylinder. When a propeller is connected to the crankshaft, it can provide the rotational inertia to transfer to the piston head via the crankshaft to effect the return stroke.

The embodiments described above are illustrative of the present invention, but it is appreciated that many other variations have utility in a variety of applications. It is appreciated that any of the variations discussed in each of the embodiments could be used in the other embodiments.

It is appreciated that a hinged member and spring could be used for either the inlet or outlet valves. It is appreciated that a variety of working fluids may be used to provide the pressure that drives this engine, including compressed air, steam, or other expansible fluids or the pressurized exhaust from an internal combustion engine. It is appreciated that combinations of reed valves and poppet valves, such as a reed valve for the inlet and a poppet valve for the outlet, are advantageous in some applications. It is appreciated that a double acting configuration with a substantially identical duplicate set of inlet and outlet valves placed in a complementary expansion chamber below the piston could be used to effectively double the power for a given engine bore, stroke and speed. It is appreciated that this engine may be used as a key component in a heat powered engine, either open cycle or closed cycle. It is appreciated that a linear induction motor, driven by a magnetic or magnetized piston, could be used to advantage, and especially in the context of a completely hermetically sealed double acting embodiment. It is appreciated that multiple cylinders may be employed together to provide dynamic balancing and smoother operation. It is appreciated that with proper phasing of multiple cylinders, the engine may be started with the provision of pressurized working fluid regardless of the initial angle of the crankshaft. It is appreciated that the addition of an overpressure relief port that is exposed as the piston approaches BDC may be useful for some applications.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the claims.

We claim:

1. An engine comprising:

a reciprocating-piston expander comprising:

an expander cylinder having an inlet and an outlet;

a piston head slidable in said expander cylinder and together enclosing an expansion chamber accessible by the inlet and the outlet;

an intake header in fluidic communication with the inlet for channeling working fluid from a pressurized fluid source into the expansion chamber;

an exhaust header in fluidic communication with the outlet for channeling working fluid exhausted out from the expansion chamber;

an inlet valve for controlling the flow of working fluid from the intake header through the inlet to effect a power stroke of the expander, said inlet valve comprising an inlet valve head and a resiliently biasing member arranged together as a harmonic oscillator so that the inlet valve head is moveable against an equilibrium restoring force of the resiliently biasing member from an unbiased equilibrium position located in the intake header to a biased closed position occluding the inlet, and so that upon releasing from the closed position the inlet valve head undergoes a single oscillation past the equilibrium position to an oppositely biased maximum open position and returns to a biased return position between the closed and equilibrium positions to choke the flow of working fluid and produce a pressure drop across the inlet valve causing the inlet valve to close, said inlet valve head protruding in part into the expansion chamber when in the closed position so as to enable the piston to bump open the inlet valve from the closed position and initiate the single oscillation of the inlet valve head;

an outlet valve for controlling the flow of working fluid exhausted out through the outlet to the exhaust header during a return stroke of the expander, said outlet valve comprising an outlet valve head, stopper, and a resiliently biasing member arranged so that the outlet valve head is moveable against an equilibrium restoring force of the resiliently biasing member from a maximum open position located in the expansion chamber and delimited by the stopper, to a biased closed position occluding the outlet;

an outlet valve closing member carried by one of the outlet valve head and the piston head and positioned therebetween so that when the other non-carrying one of the outlet valve head and the piston head comes in contact with the outlet valve closing member the outlet valve is moved by the outlet valve closing member from the maximum open position to the closed position ahead of the bump opening of the inlet valve; and periodic return means operably connected to the piston head for effecting the return stroke of the expander after each power stroke.

2. The engine of claim 1, wherein the resiliently biasing member of the inlet valve has a high quality Q factor greater than about 160 so that the return position of the inlet valve head after undergoing the single oscillation is substantially near the closed position.

3. The engine of claim 1, wherein the inlet valve head has a lower portion protruding into the expansion chamber when in the closed position so as to enable the piston to bump open the inlet valve from the closed position and initiate the single oscillation of the inlet valve head.

4. The engine of claim 3, wherein the lower portion has a convex frusto-spherical surface contour.

5. The engine of claim 3, wherein the resiliently biasing member of the inlet valve is a mono-leaf spring cantilevered with the inlet valve head connected at one end.

6. The engine of claim 1, wherein the periodic return means for effecting the return stroke of the expander after each power stroke is a crank assembly having a crankshaft operably connected to the piston head and a flywheel connected to the crankshaft to transfer rotational inertia to the piston head via the crankshaft.

7. The engine of claim 6, further comprising an induction motor operably connected to the crankshaft and capable of drawing power from a power grid to initially drive the expander at startup, and supplying power back to the power grid once operational.

8. The engine of claim 6, further comprising means for adjusting the equilibrium restoring force exerted by the resiliently biasing member of the outlet valve so as to adjust a crankshaft phase angle at which the outlet valve closes.

9. The engine of claim 1, wherein the piston head is operably connected to the periodic return means via a piston rod fixedly connected at one end to the piston head and at an opposite end to the periodic return means so as to induce a wobble motion of the piston head as it reciprocates in the expansion cylinder, the piston head having a flexible flange positioned between the piston head and the expander cylinder so as to seal the expansion chamber as the piston head undergoes the wobble motion.

10. The engine of claim 9, wherein the periodic return means is a crank assembly including a crankshaft and further comprising a propeller connected to the crankshaft to transfer rotational inertia to the piston head via the crankshaft.

11. An engine comprising:

a reciprocating-piston expander comprising:

an expander cylinder having an inlet and an outlet;

a piston head slidable in said expander cylinder and together enclosing an expansion chamber accessible by the inlet and the outlet;

an intake header in fluidic communication with the inlet for channeling working fluid from a pressurized fluid source into the expansion chamber;

an exhaust header in fluidic communication with the outlet for channeling working fluid exhausted out from the expansion chamber;

an inlet valve for controlling the flow of working fluid from the intake header through the inlet to effect a power stroke of the expander, said inlet valve comprising an inlet valve head and a resiliently biasing member arranged together as a harmonic oscillator so that the inlet valve head is moveable against an equilibrium restoring force of the resiliently biasing member from an unbiased equilibrium position located in the intake header to a biased closed position occluding the inlet, and so that upon releasing from the closed position the inlet valve head undergoes a single oscillation past the equilibrium position to an oppositely biased maximum open position and returns to a biased return position between the closed and equilibrium positions to choke the flow of working fluid and produce a pressure drop across the inlet valve causing the inlet valve to close;

an outlet valve for controlling the flow of working fluid exhausted out through the outlet to the exhaust header during a return stroke of the expander, said outlet valve comprising an outlet valve head, stopper, and a resiliently biasing member arranged so that the outlet valve head is moveable against an equilibrium restoring force of the resiliently biasing member from a maximum open position located in the expansion chamber and delimited by the stopper, to a biased closed position occluding the outlet;

a protrusion carried by one of the inlet valve head and the piston head and positioned therebetween so that when the other non-carrying one of the inlet valve head and the piston head comes in contact with the protrusion the inlet valve is bumped open from the closed position to initiate the single oscillation of the inlet valve head; and an outlet valve closing member carried by one of the outlet valve head and the piston head and positioned therebetween so that when the other non-carrying one of the outlet valve head and the piston head comes in contact with the outlet valve closing member the outlet valve is moved by the outlet valve closing member from the maximum open position to the closed position ahead of the bump opening of the inlet valve; and periodic return means operably connected to the piston head for effecting the return stroke of the expander after each power stroke.

12. The engine of claim 11, wherein the resiliently biasing member of the inlet valve has a high quality Q factor greater than about 160 so that the return position of the inlet valve head after undergoing the single oscillation is substantially near the closed position.

13. The engine of claim 11, wherein the protrusion is an inlet valve opening spring.

14. The engine of claim 13, wherein the inlet valve opening spring is carried by the piston head and the inlet valve head has a concave lower surface to accommodate the inlet valve opening spring as it is resiliently biased.

15. The engine of claim 11, wherein the resiliently biasing member of at least one of the inlet valve and the outlet valve is a mono-leaf spring cantilevered with the respective inlet valve head or outlet valve head connected at one end.

16. The engine of claim 11, wherein the piston head is operably connected to the periodic return means via a piston rod fixedly connected at one end to the piston head and at an opposite end to the periodic return means so as to induce a wobble motion of the piston head as it reciprocates in the expansion cylinder, the piston head having a flexible flange positioned between the piston head and the expander cylinder so as to seal the expansion chamber as the piston head undergoes the wobble motion.

17. The engine of claim 16, wherein the periodic return means is a crank assembly including a crankshaft and further comprising a propeller connected to the crankshaft to transfer rotational inertia to the piston head via the crankshaft.

* * * * *